US008973612B2

(12) United States Patent
Sawaski et al.

(10) Patent No.: US 8,973,612 B2
(45) Date of Patent: Mar. 10, 2015

(54) CAPACITIVE SENSING ELECTRONIC FAUCET INCLUDING DIFFERENTIAL MEASUREMENTS

(75) Inventors: Joel D. Sawaski, Indianapolis, IN (US); Adam M. Devries, Anderson, IN (US); Robert W. Rodenbeck, Indianapolis, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 195 days.

(21) Appl. No.: 13/495,525

(22) Filed: Jun. 13, 2012

(65) Prior Publication Data

US 2012/0318364 A1 Dec. 20, 2012

Related U.S. Application Data

(60) Provisional application No. 61/497,793, filed on Jun. 16, 2011.

(51) Int. Cl.
*F15B 13/00* (2006.01)
*E03C 1/05* (2006.01)

(52) U.S. Cl.
CPC ..... *E03C 1/055* (2013.01)
USPC ..... 137/801; 137/1; 251/129.04; 4/623

(58) Field of Classification Search
CPC ..... E03C 1/05; E03C 1/057; E03D 5/105; F16K 19/006; F16K 31/02
USPC ..... 137/801; 251/129.04; 4/623
See application file for complete search history.

(56) References Cited

U.S. PATENT DOCUMENTS

| | | | |
|---|---|---|---|
| 3,585,653 | A | 6/1971 | Forbes et al. |
| 4,258,444 | A | 3/1981 | Orszullok |
| 4,756,031 | A | 7/1988 | Barrett |
| 4,780,705 | A | 10/1988 | Beane |
| 5,175,505 | A | 12/1992 | Magenau et al. |
| 5,730,165 | A | 3/1998 | Philipp |
| 5,940,899 | A | 8/1999 | Mankin et al. |
| 6,052,841 | A | 4/2000 | Mankin et al. |
| 6,279,179 | B1 | 8/2001 | Register |
| 6,877,170 | B1 | 4/2005 | Quintana et al. |
| 6,934,977 | B1 | 8/2005 | Quintana et al. |
| 6,962,168 | B2 | 11/2005 | McDaniel et al. |
| 7,015,704 | B1 | 3/2006 | Lang |
| 7,150,293 | B2 | 12/2006 | Jonte et al. |
| 7,156,363 | B2 | 1/2007 | Parsons et al. |
| 7,232,111 | B2 | 6/2007 | McDaniel et al. |
| 7,458,520 | B2 | 12/2008 | Belz et al. |
| 7,690,395 | B2 | 4/2010 | Jonte et al. |

(Continued)

FOREIGN PATENT DOCUMENTS

WO WO 2007/082301 1/2006

*Primary Examiner* — Matthew W Jellett
(74) *Attorney, Agent, or Firm* — Faegre Baker Daniels LLP

(57) ABSTRACT

A fluid delivery device including an electronic faucet having a plurality of faucet components, and a primary capacitive sensor coupled to at least one of the faucet components and providing a primary output signal. At least one secondary capacitive sensor is located on or near an item which causes unintended effects on the output signal from the primary capacitive sensor and provides a secondary output signal. A controller determines a difference signal between the primary and secondary output signals of the primary and secondary capacitive sensors to control operation of the electronic faucet.

15 Claims, 3 Drawing Sheets

(56) References Cited

U.S. PATENT DOCUMENTS

| | | | | |
|---|---|---|---|---|
| 7,814,582 | B2 | 10/2010 | Reddy et al. | |
| 7,997,301 | B2 | 8/2011 | Marty et al. | |
| 8,166,996 | B2 | 5/2012 | Canfield et al. | |
| 8,237,456 | B2 | 8/2012 | Dubery | |
| 8,381,329 | B2 * | 2/2013 | Bayley et al. | 4/623 |
| 2003/0019367 | A1 | 1/2003 | Fogagnolo et al. | |
| 2008/0109956 | A1 | 5/2008 | Bayley et al. | |
| 2009/0229683 | A1 | 9/2009 | Baek et al. | |
| 2009/0293192 | A1 | 12/2009 | Pons | |
| 2010/0012194 | A1 | 1/2010 | Jonte et al. | |
| 2010/0108165 | A1 | 5/2010 | Rodenbeck et al. | |
| 2010/0170570 | A1 | 7/2010 | Rodenbeck et al. | |
| 2010/0252759 | A1 | 10/2010 | Guler et al. | |
| 2012/0318364 | A1 | 12/2012 | Sawaski et al. | |

* cited by examiner

CAPACITIVE SENSING ELECTRONIC FAUCET INCLUDING DIFFERENTIAL MEASUREMENTS

CROSS-REFERENCE TO RELATED APPLICATION

This application claims priority to U.S. Provisional Application Ser. No. 61,497,793, filed Jun. 16, 2011.

BACKGROUND AND SUMMARY

The present disclosure relates generally to electronic faucets. Electronic faucets are often used to control fluid flow. Electronic faucets may include proximity sensors such as active infrared ("IR") proximity detectors or capacitive proximity sensors. Such proximity sensors are used to detect a user's hands positioned near the faucet, and turn the water on and off in response to detection of the user's hands. Other electronic faucets may use touch sensors to control the faucet. Such touch sensors include capacitive touch sensors or other types of touch sensors located on a spout of the faucet or on a handle for controlling the faucet. Capacitive sensors on the faucet may also be used to detect both touching of faucet components and proximity of the user's hands adjacent the faucet In capacitive sensing faucet applications, other components located near the electronic faucet may have unintended effects on the output signal from the capacitive sensors. For instance, a user touching a metal sink basin may induce a false capacitive signal at the capacitive sensors. Changes that occur below a sink deck may also cause false readings at the capacitive sensors.

In an illustrated embodiment of the present disclosure, a fluid delivery device includes an electronic faucet having a plurality of faucet components, and a primary capacitive sensor coupled to a component of the electronic faucet to sense a user touching or in proximity to the faucet component. The primary capacitive sensor provides an output signal. The fluid delivery device also includes at least one secondary capacitive sensor located on or near an item which causes unintended effects on the output signal from the primary capacitive sensor. Each secondary capacitive sensor also provides an output signal. The fluid delivery device further includes a controller coupled to the primary and secondary capacitive sensors. The controller determines a difference signal between the output signals of the primary and secondary capacitive sensors. The difference signal is used by the controller to detect when a user touches or is in proximity to the faucet component.

In illustrated embodiments, the at least one secondary sensor is at least one of a metal plate or electrode located near or coupled to the metal sink basin, a sensor coupled to a sense wire from the primary capacitive sensor, a sensor coupled to a drain to sense fluid going down the drain, a sensor coupled to a garbage disposal, and a sensor coupled to a fluid supply line. In other illustrated embodiments, the at least one secondary sensor is coupled to water-carrying equipment located below a sink deck, or to metal equipment or other equipment connected to water or located below the sink deck. In another illustrated embodiment, the at least one secondary sensor is used as an antenna to reduce electromagnetic interference (EMI) or electrostatic discharge (ESD) false activations.

In a further illustrative embodiment of the present disclosure, a fluid delivery device includes an electronic faucet having a spout, and an electrically operable valve to control water flow through the spout. A primary capacitive sensor is coupled to the spout, the primary capacitive sensor providing a primary output signal in response to a user input to the spout. A secondary capacitive sensor is coupled to a secondary component which causes unintended effects on the primary output signal from the primary capacitive sensor, the secondary capacitive sensor providing a secondary output signal in response to user input to the secondary component. A controller is coupled to the primary and secondary capacitive sensors, the controller determining a difference signal between the primary and secondary output signals of the primary and secondary capacitive sensors, the difference signal being used by the controller to control operation of the electrically operable valve.

A method of controlling an electronic faucet includes the steps of capacitively sensing a user touching or in proximity to a faucet component and providing a primary output signal in response thereto, and capacitively sensing input from an item which causes unintended effects on the primary output signal and providing a secondary output signal in response thereto. The method further includes determining a signal difference between the primary and secondary output signals to detect when a user touches or is proximity to the faucet component.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
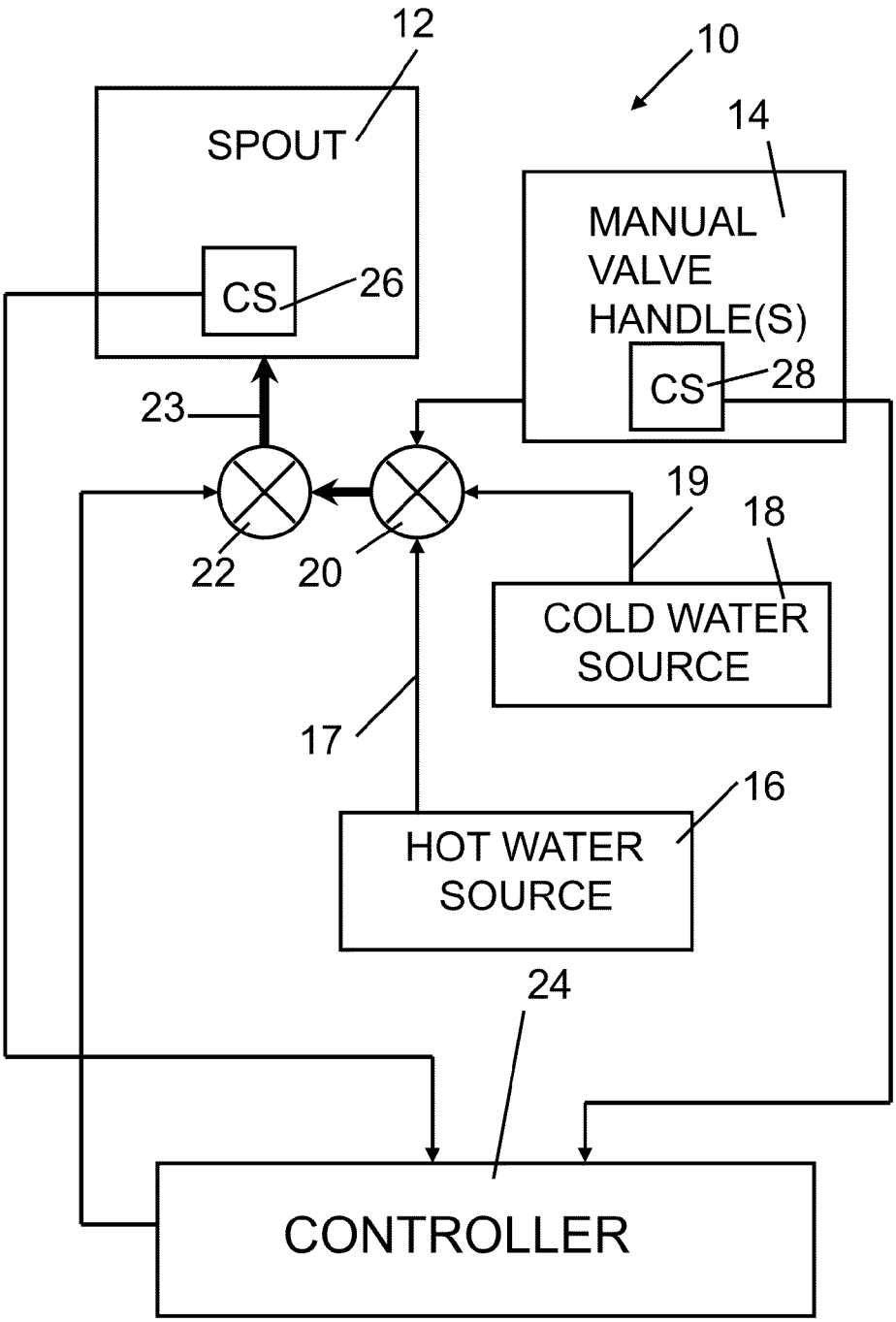
FIG. 1 is a block diagram of an illustrated embodiment electronic faucet.

For the purposes of promoting an understanding of the principles of the present disclosure, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of the principles of the invention which would normally occur to one skilled in the art to which the invention relates.

FIG. 1 is a block diagram showing one illustrative embodiment of an electronic faucet 10 of the present disclosure. The faucet 10 illustratively includes a spout 12 for delivering fluids such as water and at least one manual valve handle 14 for controlling the flow of fluid through the spout 12 in a manual mode. A hot water source 16 and cold water source 18 are coupled to a manual valve body assembly 20 by fluid supply lines 17 and 19, respectively. The valve handle 14 is operably coupled to the manual valve body assembly 20 to control water flow therethrough.

In one illustrated embodiment, separate manual valve handles 14 are provided for the hot and cold water sources 16, 18. In other embodiments, such as a kitchen faucet embodiment, a single manual valve handle 14 is used for both hot and cold water delivery. In such kitchen faucet embodiment, the manual valve handle 14 and spout 12 are typically coupled to a basin through a single hole mount. An output of valve body assembly 20 is coupled to an actuator driven valve 22 which is controlled electronically by input signals received from a controller 24. In an illustrative embodiment, actuator driven valve 22 is an electrically operable valve, such as a solenoid valve. An output of actuator driven valve 22 supplies fluid to the spout 12 through supply line 23.

In an alternative embodiment, the hot water source 16 and cold water source 18 are connected directly to actuator driven valve 22 to provide a fully automatic faucet without any manual controls. In yet another embodiment, the controller 24 controls an electronic proportioning valve (not shown) to supply fluid to the spout 12 from hot and cold water sources 16, 18.

Because the actuator driven valve 22 is controlled electronically by controller 24, flow of water can be controlled using outputs from sensors such as capacitive sensors 26, 28. As shown in FIG. 1, when the actuator driven valve 22 is open, the faucet 10 may be operated in a conventional manner, i.e., in a manual control mode through operation of the handle(s) 14 and the manual valve member of valve body assembly 20. Conversely, when the manually controlled valve body assembly 20 is set to select a water temperature and flow rate, the actuator driven valve 22 can be touch controlled, or activated by proximity sensors when an object (such as a user's hands) are within a detection zone to toggle water flow on and off.

In one illustrated embodiment, spout 12 has a capacitive sensor 26 connected to controller 24. In addition, the manual valve handle(s) 14 also have capacitive sensor(s) 28 mounted thereon which are electrically coupled to controller 24. The output signals from capacitive sensors 26, 28 are used to control actuator driven valve 22 which thereby controls flow of water to the spout 12 from the hot and cold water sources 16 and 18. By sensing capacitance changes with capacitive sensors 26, 28, the controller 24 can make logical decisions to control different modes of operation of faucet 10 such as changing between a manual mode of operation and a hands free mode of operation as further described in U.S. Application Publication No. 2010/0170570; and U.S. Pat. Nos. 7,690,395 and 7,150,293; and 7,997,301, the disclosures of which are all expressly incorporated herein by reference. Another illustrated configuration for a proximity detector and logical control for the faucet in response to the proximity detector is described in greater detail in U.S. Pat. No. 7,232,111, which is hereby incorporated by reference in its entirety.

The amount of fluid from hot water source 16 and cold water source 18 is determined based on one or more user inputs, such as desired fluid temperature, desired fluid flow rate, desired fluid volume, various task based inputs, various recognized presentments, and/or combinations thereof. As discussed above, the faucet 10 may also include an electronically controlled proportioning or mixing valve which is in fluid communication with both hot water source 16 and cold water source 18. Exemplary electronically controlled mixing valves are described in U.S. patent application Ser. No. 11/109,281 and PCT International Application Serial No. PCT/US2007/060512, the disclosures of which are expressly incorporated by reference herein.

Figure 2:
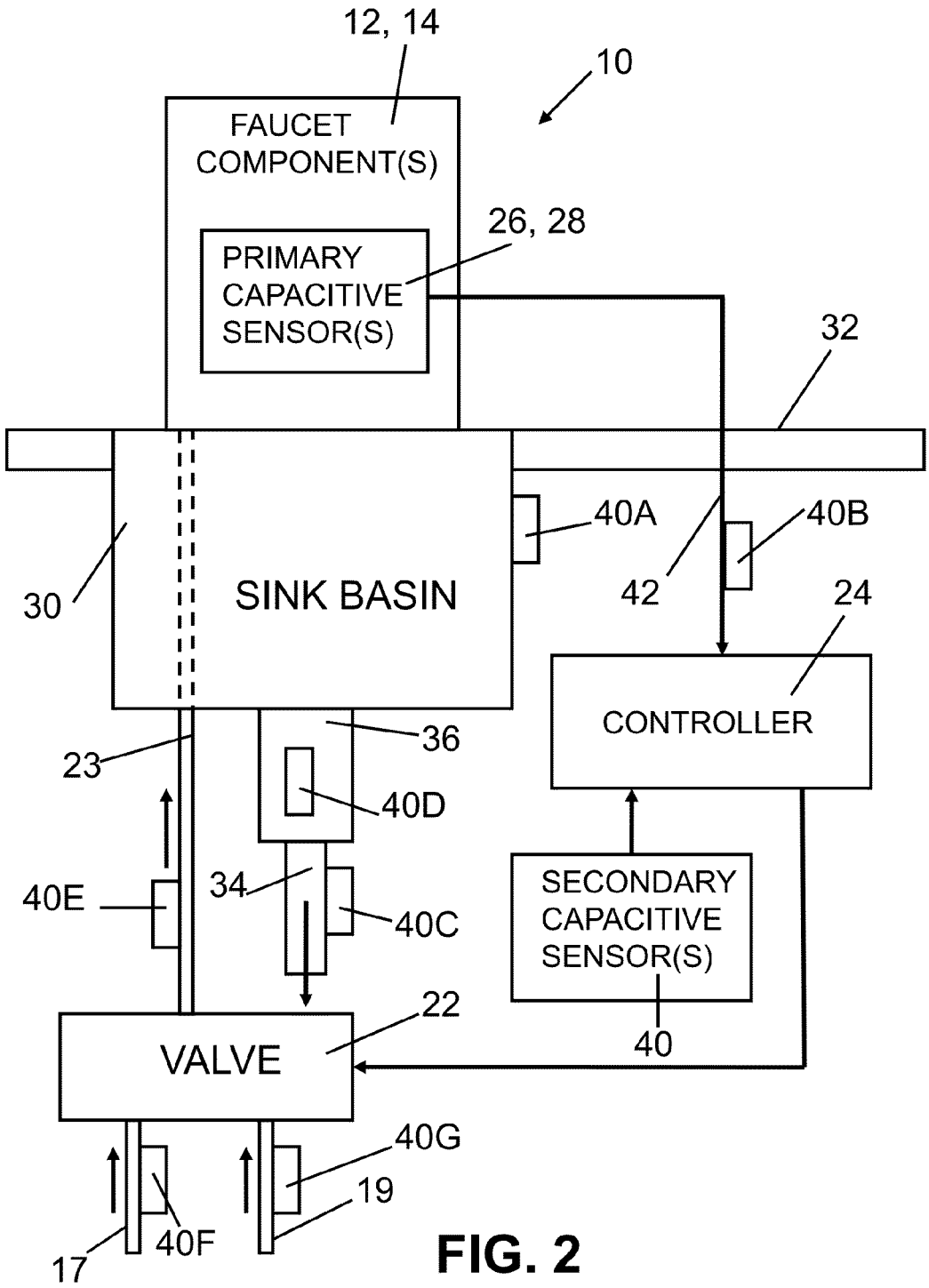
FIG. 2 is a block diagram illustrating further details of the electronic faucet of an illustrated embodiment of the present disclosure including at least one primary capacitive sensor coupled to a component of the faucet, such as a spout or a handle, and a plurality of secondary capacitive sensors to measure unintended capacitive signals near the faucet.

Additional details of an exemplary embodiment of the electronic faucet are illustrated in FIG. 2. FIG. 2 illustrates a faucet 10 including at least one primary capacitive sensor 26, 28 located on a component of the faucet such as a spout 12 or a handle 14 as discussed above. The primary capacitive sensor 26, 28 detects touching of a faucet component or proximity of a user in a detection region located near the faucet component. The primary capacitive sensor(s) 26, 28 is (are) illustratively coupled to a processor or controller 24 used to actuate valve 22 in response to detecting the touching of the faucet 10 or detecting the user (e.g. hands, arms, etc.) in close proximity to the faucet 10 for hands-free activation of the faucet 10 as discussed above.

In capacitive sensing in faucet applications, other components located near the faucet 10 may have unintended effects on the output signal from the primary capacitive sensor(s) 26, 28. For instance, a user touching a metal sink basin 30 may induce a false capacitive signal at the primary capacitive sensor(s) 26, 28. Changes that occur below a sink deck 32 may also cause false readings at the primary capacitive sensor(s) 26, 28. These below deck changes may include, for example, water going down a drain 34 or someone moving an object below the deck 32. A garbage disposal 36 or other static electricity source may also have an effect on readings of the primary capacitive sensor(s) 26, 28. In addition, a 60 Hz hum of AC power systems located below the deck 32 may also affect the primary capacitive sensor(s) 26, 28 output signals.

In order to counter the unintended effects discussed above, the present system uses at least one secondary capacitive sensor 40 to detect the unintended capacitive signals. Multiple secondary capacitive sensors 40A-40G are illustrated in FIG. 2. Sensors 40A-40G are used to reduce different capacitive effects in a faucet 10. For instance, secondary capacitive sensor 40A is illustratively a metal plate or electrode located near or coupled to the metal sink basin 30 to reduce the effect of touching the metal sink basin 30. Such touching of the basin 30 may be confused by the controller 24 as a hands-free or proximity activation of the primary sensor(s) 26, 28.

Secondary capacitive sensor 40B is wrapped around or otherwise coupled to a sense wire 42 from primary capacitive sensor(s) 26, 28 to reduce the likelihood of activating the faucet 10 when the below deck sense wire 42 is moved or touched. A secondary capacitive sensor 40 may also be used as an antenna to reduce electromagnetic interference (EMI) or electrostatic discharge (ESD) false activations.

In an illustrated embodiment, a secondary sensor 40C is used to sense water going down the drain 34. Sensor 40C is useful to detect capacitive changes when water flows from sink basin 30 through drain 34. A secondary capacitive 40 may also be used on other drains under the sink, such as dishwasher drains or the like. Secondary capacitive sensors 40 are useful on any water-carrying equipment located below the deck 32 or under the sink basin 30, and any metal equipment or other equipment connected to water or located under the sink deck 32.

FIG. 2 also illustrates a secondary capacitive sensor 40D coupled to the garbage disposal 36. In addition, sensors 40E, 40F and 40G are shown coupled to fluid supply lines 23, 17 and 19, respectively, to sense capacitive changes when water flows therethrough.

Figure 3:
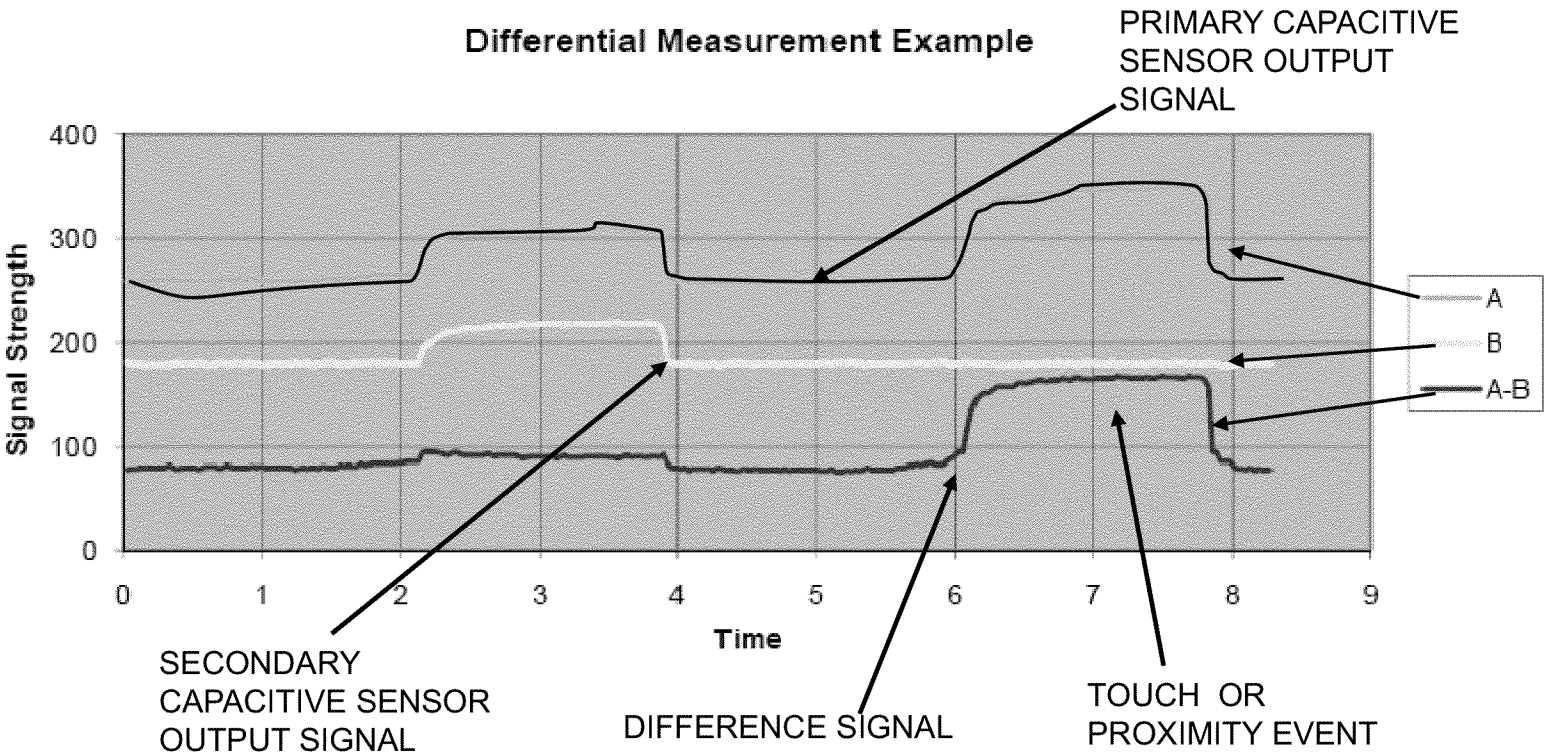
FIG. 3 illustrates exemplary output signals from a primary capacitive sensor and a secondary capacitive sensor, and a difference signal between the primary and secondary capacitive sensor output signals.

As shown in FIG. 3, an output signal from the at least one secondary capacitive sensor 40 is subtracted from the primary capacitive sensor(s) 26, 28 output signal so that the controller 24 more accurately measures the touch or proximity readings from the primary capacitive sensor(s) 26, 28. As shown in FIG. 3, signal A is the output signal from a primary capacitive sensor 26, 28 and signal B is the output signal from a secondary capacitive sensor 40. When B is subtracted from A, the touch or proximity event from the primary sensor(s) 26, 28 is easier to detect in the difference signal (A-B). The controller 24 processes the difference signal to more accurately measure the touch or proximity events detected by the primary capacitive sensor(s) 26, 28. In other words, the controller 24 accounts for input from the secondary capacitive sensor 40 when deciding whether to take action (e.g., control actuator driven valve 22).

While this disclosure has been described as having exemplary designs and embodiments, the present invention may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains. Therefore, although the invention has been described in detail with reference to certain illustrated embodiments, variations and modifications exist within the spirit and scope of the invention as described and defined in the following claims.

The invention claimed is:

1. A fluid delivery device comprising:

an electronic faucet having a plurality of faucet components, the plurality of faucet components including a spout and a manual valve handle to control a manual valve;

a primary capacitive sensor coupled to at least one of the faucet components of the electronic faucet to sense a user touching or in proximity to the faucet component, the primary capacitive sensor providing a primary output signal;

at least one secondary capacitive sensor located on or near an item which causes unintended effects on the primary output signal from the primary capacitive sensor, each said at least one secondary capacitive sensor providing a secondary output signal; and a controller coupled to the primary and secondary capacitive sensors, the controller determining a difference signal between the primary and secondary output signals of the primary and secondary capacitive sensors, the difference signal being used by the controller to detect when a user touches or is in proximity to the faucet component;

wherein the electronic faucet is configured to dispense water into a metal sink basin, the at least one secondary sensor is at least one of a metal plate or electrode located near or coupled to the metal sink basin.

2. The fluid delivery device of claim 1, wherein a first primary capacitive sensor is coupled to the spout to provide a first primary output signal, and a second primary capacitive sensor is located on the manual valve handle to provide a second primary output signal, the controller determining which of the manual valve handle and the spout is touched by a user based on at least one difference signal between the first and second primary output signals.

3. The fluid delivery device of claim 1, wherein the faucet components of the electronic faucet includes a faucet body hub, the manual valve handle being electrically coupled to the faucet body hub, and a spout coupled to the faucet body hub by an insulator so that the spout is electrically isolated from the faucet body hub, and wherein the primary capacitive sensor is coupled to one of the faucet body hub and the manual valve handle, the controller determined which of the manual valve handle and the spout is touched by a user based on the difference signal.

4. The fluid delivery device of claim 1, wherein the at least one secondary capacitive sensor comprises at least one of a sensor coupled to a sense wire from the primary capacitive sensor, a sensor coupled to a drain to sense fluid going down the drain, a sensor coupled to a garbage disposal, and a sensor coupled to a fluid supply line.

5. The fluid delivery device of claim 1, wherein the at least one secondary sensor is coupled to water-carrying equipment located below a sink deck, or to metal equipment connected to water and located below the sink deck.

6. The fluid delivery device of claim 1, wherein the at least one secondary sensor is used as an antenna to reduce EMI or ESD false activations.

7. A fluid delivery device comprising:

an electronic faucet including a spout, a manual valve handle to control a manual valve, and an electrically operable valve to control water flow through the spout;

a primary capacitive sensor coupled to the spout, the primary capacitive sensor providing a primary output signal in response to a user input to the spout;

a secondary capacitive sensor coupled to a secondary component which causes unintended effects on the primary output signal from the primary capacitive sensor, the secondary capacitive sensor providing a secondary output signal in response to user input to the secondary component; and a controller coupled to the primary and secondary capacitive sensors, the controller determining a difference signal between the primary and secondary output signals of the primary and secondary capacitive sensors, the difference signal being used by the controller to control operation of the electrically operable valve;

wherein the spout of the electronic faucet is configured to dispense water into a metal sink basin, and the secondary sensor is at least one of a metal plate or an electrode located near or coupled to the metal sink basin.

8. The fluid delivery device of claim 7, wherein the user input to the primary capacitive sensor comprises a user touching or being in proximity to the faucet component, and the user input to the secondary component comprises a user touching or being in proximity to the secondary component.

9. The fluid delivery device of claim 7, wherein a first primary capacitive sensor is coupled to the spout to provide a first primary output signal, and a second primary capacitive sensor is located on the manual valve handle to provide a second primary output signal, the controller determining which of the manual valve handle and the spout is touched by a user based on at least one difference signal between the first and second primary output signals.

10. The fluid delivery device of claim 7, wherein the secondary capacitive sensor comprises at least one of a sensor coupled to a sense wire from the primary capacitive sensor, a sensor coupled to a drain to sense fluid going down the drain, a sensor coupled to a garbage disposal, and a sensor coupled to a fluid supply line.

11. The fluid delivery device of claim 7, wherein the secondary capacitive sensor is coupled to water-carrying equipment located below a sink deck, or to metal equipment connected to water and located below the sink deck.

12. The fluid delivery device of claim 7, wherein the secondary capacitive sensor is used as an antenna to reduce EMI or ESD false activations.

13. A method of controlling an electronic faucet, the method comprising the steps of:

capacitively sensing a user touching or in proximity to a plurality of faucet components including a spout and manual valve handle controlling a manual valve, at least one of said plurality of faucet components providing a primary output signal in response thereto;

capacitively sensing input from an item which causes unintended effects on the primary output signal and providing a secondary output signal in response thereto;

determining a signal difference between the primary and secondary output signals to detect when a user touches or is proximity to at least one of the plurality of faucet components; and dispensing water into a metal sink basin, wherein the secondary output signal is provided by a capacitive sensor coupled to the metal sink basin.

14. The method of claim 13, further comprising the step of activating an electrically operable valve after detecting that a user touches or is in proximity to at least one of the plurality of faucet components.

15. The method of claim 13, wherein the primary output signal is provided by a primary capacitive sensor coupled to at least one of the plurality of faucet components, and the secondary output signal is provided by a secondary capacitive sensor coupled to at least one of a sense wire from the primary capacitive sensor, a sensor coupled to a drain to sense fluid going down the drain, a sensor coupled to a garbage disposal, and a sensor coupled to a fluid supply line.

* * * * *